United States Patent [19]

Henger et al.

[11] Patent Number: 4,764,393

[45] Date of Patent: Aug. 16, 1988

[54] METHOD FOR MONITORING THE OPERATION OF AN ELECTROSTATIC COATING INSTALLATION

[76] Inventors: Peter Henger, Schiessmauerstrasse 11, D-7123 Sachsenheim; Fred Luderer, Schillerstrasse 30, D-7057 Leutenbach 2, both of Fed. Rep. of Germany

[21] Appl. No.: 808,848

[22] Filed: Dec. 13, 1985

[30] Foreign Application Priority Data

Dec. 17, 1984 [DE] Fed. Rep. of Germany ..... 3445946

[51] Int. Cl.[4] ..... B05D 1/06

[52] U.S. Cl. ..... 427/8; 427/33

[58] Field of Search ..... 427/8, 33; 118/671, 118/713, 697, 698, 690, 712; 361/235

[56] References Cited

U.S. PATENT DOCUMENTS 4,092,440 5/1978 Wöhr et al. ..... 427/33
4,257,347 3/1981 Stahl ..... 118/690 X
4,402,030 8/1983 Moser et al. ..... 118/671 X
4,469,723 9/1984 Haq ..... 118/698 X

*Primary Examiner*—Evan K. Lawrence
*Attorney, Agent, or Firm*—Reising, Ethington, Barnard, Perry & Milton

[57] ABSTRACT

In the electrostatic coating of large workpieces, for example vehicle bodies, the installation must be switched off automatically in order to avoid a voltage breakdown when the operating current rises to a threshold value predetermined as a function of the operating voltage which is adjustable over a certain range. To this end, all threshold values applicable to selectable voltage values are stored jointly, more particularly in a microprocessor, and when the installation is in operation, they are selected automatically according to the voltage which has been adjusted. A warning signal is produced when an intermediate threshold value of the current is exceeded, where the intermediate value has been automatically adjusted between the normal and threshold values of the current.

3 Claims, 2 Drawing Sheets

METHOD FOR MONITORING THE OPERATION OF AN ELECTROSTATIC COATING INSTALLATION

TECHNICAL FIELD

The invention relates to a method for monitoring the operation of an electrostatic coating installation.

BACKGROUND ART

In the electrostatic coating of workpieces, which are usually placed by an automatic conveyor system in a spray-cabin, or the like, coating station and are moved relatively to one or more paint-spraying devices, a high voltage is applied between the workpiece and each paint-spraying device. In order to take account of the operating conditions (the workpiece, the type of enamel, atmospheric conditions, etc.), the magnitude of the voltage must be variable, i.e. between about 60 and 110 V in the case of vehicle bodies.

During the coating operation, care must be taken for safety reasons to ensure that the strength of the electrical field cannot reach a value which could produce a dangerous voltage breakdown or spark discharge. A disruptive field strength occurs when the distance between the paint-spraying device and the workpiece is insufficient, i.e. if the guidance of the workpiece is unstable or in the case of vehicle bodies, if doors or hoods are inadvertently opened. Since there is no practical way of measuring the strength of the field in a coating installation, the operating current of the high-voltage source is monitored. The installation is automatically shut off when the operating current reaches a predetermined current threshold which, if is exceeded, presents a danger of voltage breakdown. Since the current flowing between the high-voltage electrodes rises sharply just before reaching the disruptive field strength, the danger of a voltage breakdown can be eliminated as long as the operating current does not exceed the normal value, which is measured at the beginning of the operation, by more than a predetermined amount.

However, accurate and reliable adjustment of the relevant current threshold presents considerable problems. The operating current, especially in the upper range of selectable voltage values, does not change linearly with the voltage. The measured operating current is only partly the current-flowing between the electrodes and has additional components, including a shunt-current flowing from the high-voltage source through the enamel-supply system. At the start of the operation, this shunt-current may already be substantially higher than the electrode-current and as the operation proceeds, it may gradually increase considerably as a result of increasing contamination of its path. The magnitude of this current, however, is no indication of the field strength to be monitored. On the other hand, it is not immediately possible to measure the electrode-current only.

According to a method now commonly used, in the case of the electrostatic coating installation for vehicle bodies in which the high voltage can be varied by means of a step-switch, for example 5 steps of 10 kV each, the normal operating current for the voltage step selected is measured before the coating operation starts. A current threshold is adjustable manually by means of a potentiometer associated with the voltage step selected. The current threshold is higher by a specific amount than the measured normal current. If the voltage is altered, the procedure is repeated with another potentiometer associated with the new voltage step.

For various reasons this method is not satisfactory. In the first place, it would be desirable to be able to vary the voltage in substantially smaller steps, or quasi steplessly, but this cannot be done with the conventional method since the number of potentiometers would have to equal the number of selectable voltage-steps. This would not only be costly, but would also take up too much space. It must also be taken into account that it is usual to have several simultaneously operating sprayers in a coating station and that the high-voltage field of each sprayer requires its own monitoring system. For instance, if there are 10 sprayers, and if their respective operating voltages are to be variable between 60 and 110 kV in one 1 V steps, a total of 500 potentiometers would have to be installed.

Another disadvantage is the effort and possible unreliability associated with manual adjustment of the potentiometers which determine the current threshold. The fact is that these potentiometers must be located in locked control-boxes or must be protected in some other way from unauthorized adjustment. Finally, unwanted shutdowns may occur if the current threshold is reached without any danger of voltage breakdown. This may occur as a result of increasing contamination of the aforesaid shunt-current path or because of some other relatively slow changes in operating conditions (heating-up, atmospheric changes, etc.) with the operating personnel not being informed in time.

German OS No. 27 34 341 discloses a current-monitoring system for the electrostatic coating of vehicle bodies which has steplessly selectable voltages. The safety shut-off is triggered only in the event of rapid changes in current resulting from parts of the body coming dangerously close to the high-voltage spraying units. It is not triggered by gradual changes in current caused, for example, by gradual contamination of the installation. The operating current is measured at frequent intervals (every 200 ms) with the aid of a scanning and holding circuit. The measured value is compared with the previous measured value which has been stored as a reference value, after which the actual measured value is stored as the new reference value. Thus, the reference value with which the operating current is constantly compared grows with the gradually increasing operating current. If, within the stated time interval, the current increases by more than a specifically adjustable differential amount, the shut-off is triggered. But again, in this known system, which comprises a relatively costly circuit arrangement, dynamic current-monitoring is supplemented by a predetermined static limit-current value which must under no circumstances be exceeded. This predetermined value is set manually by the operating personnel. Here again, as in the case of the step-method described hereinbefore, there is no way of forewarning the crew. For example, if as a result of increasing contamination of the installation, the operating current approaches the static limit-value at which the unit is shut down, the crew will not be forewarned even though there is no danger of a voltage breakdown.

SUMMARY OF THE INVENTION

It is therefore the purpose of the invention, to provide, without excessive cost, a method which allows automatic adaptation of the shut-off threshold at the particular voltage selected, as in the case of a safety shut-off for an electrostatic coating installation operating at a high voltage which can be varied in very small steps.

The method of the invention eliminates manual adjustment of the shut-off threshold and also manual voltage-dependent changes carried out with a plurality of potentiometers. Further, it is also possible to forewarn the operating personnel that the operating current is approaching the shut-off threshold as a result of changing operating conditions which do not increase the danger of a voltage breakdown.

BRIEF DESCRIPTION OF THE DRAWINGS

The invention is explained hereinafter in greater detail in conjunction with the example of embodiment illustrated in the drawing attached hereto wherein.

DESCRIPTION OF PREFERRED EMBODIMENT

Figure 1:
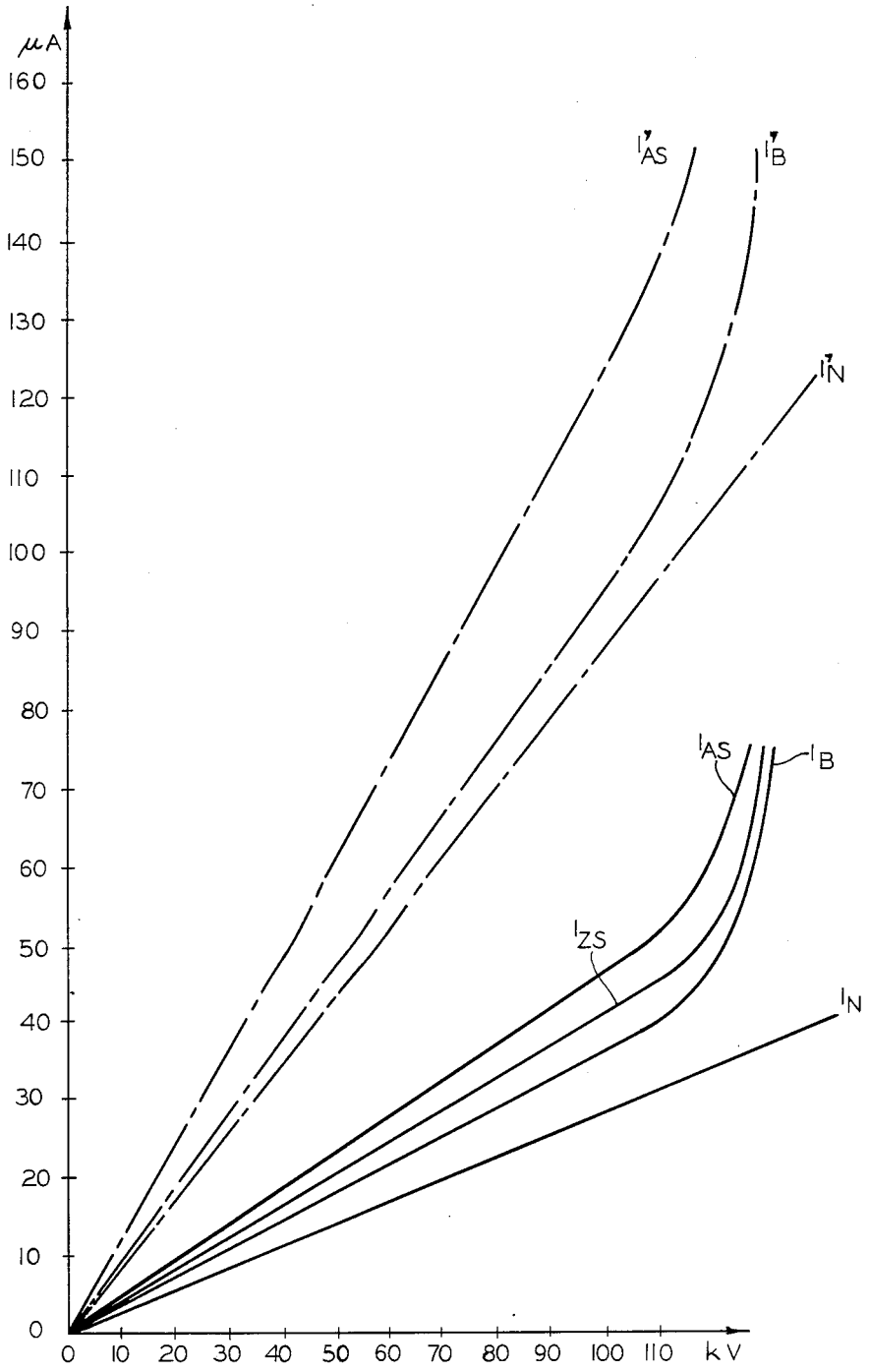
FIG. 1 shows the current pattern as a function of the adjustable operating voltage of an electrostatic coating installation for vehicle bodies.

If the spraying cabin of an electrostatic installation for coating vehicle bodies is fed by an automatic conveying system, the operating current $I_B$ of the high voltage source is measured as a function of the high voltage—which is freely selectable within a range of up to 110 kV—between the spraying device and the body to be coated. The typical curve for this current $I_B$, is illustrated in FIG. 1. The operating current $I_B$ consists essentially of two components, namely a shunt-current $I_N$ which follows from the high-voltage source, bypassing the spraying device (conventionally operating at high-voltage potential) through the enamel-feed-line thereof and other shunt paths to ground, and the electrode-current between the spraying device and the workpiece. The electrode current is added to the shunt-current $I_N$ and corresponds to the vertical distance between the curves for current $I_N$ and $I_B$ in FIG. 1. Neither the electrode-current nor the shunt-current $I_N$ can be measured immediately alone. The curves for current $I_N$ and $I_B$ apply for a given electrode-distance between the workpiece and the spraying device for normal operating conditions. If the electrode-distance is reduced, the electrode-current and therefore the operating current $I_B$ would rise to a breakdown-value which, as a function of the voltage set, lies upon a curve (not shown) similar to that of the operating current $I_B$. In order to avoid the breakdown-danger, it is necessary to shut off the high-voltage installation upon reaching a predetermined current threshold corresponding to curve $I_{AS}$. However, even with no change in the electrode-distance and with no breakdown-danger, the operating current $I_B$ can increase considerably as the operation proceeds. For example, as a result of increasing contamination and/or other changes, a reduction in shunt-resistance to ground and a corresponding increase in shunt-current $I_N$ occurs. This increase, for example in curves $I_N'$ and $I_B'$ for which switch-off curve $I'_{AS}$ would then apply, may lead in known systems to an unwanted but practically unavoidable plant shut-down during the coating operation.

Furthermore, voltage/current curves of a considerably different pattern may occur as a result of changes in normal conditions, as for example, different normal electrode-distance or different types of enamel. In the case of different types of enamel in which the electrical resistances may differ sharply from each other, the normal operating current may correspond, in one case for example to curve $I_B$ and, in another case, to curve $I'_B$ in FIG. 1.

Figure 2:
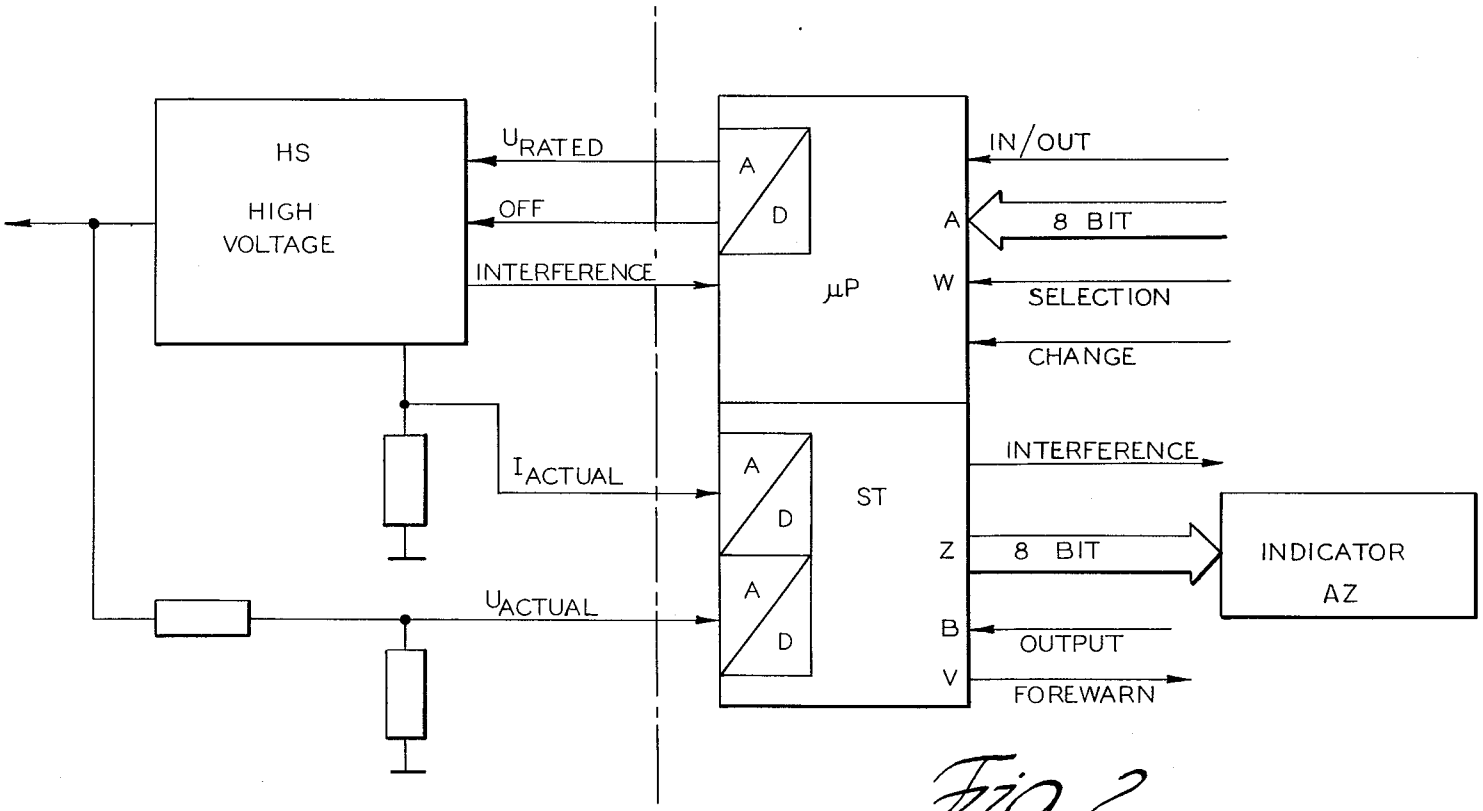
FIG. 2 is a diagrammatical representation of an arrangement for monitoring the operation of the coating installation.

In the case of the monitoring method described herein, the value of operating current $I_B$ is measured before the actual coating operation begins, initially under normal conditions for each selectable voltage-value, the latter being preferably adjusted in small steps of 1 kV or 0.5 kV each, i.e. almost steplessly. The operating current values are preferably binary-coded and are fed to a microprocessor $\mu$P (FIG. 2) which, by amplification to a certain degree (e.g. 30%), calculates the current-threshold values according to curve $I_{AS}$ pertaining to the different voltage values. The measured operating-current values, and/or the threshold values calculated therefrom, may be stored in the microprocessor data-storage, and the calculations may therefore be carried out before, during or after storage, or even at the moment of subsequent data-release.

It is also a simple matter to store values of different voltage/current curves for different normal conditions, as for example, different types of enamel. These values may then be selected at a later date according to prevailing conditions.

Regardless of the other possibilities mentioned, it appears desirable to store the threshold values calculated by the microprocessor immediately. For reading, the memory may be addressed by a binary code fed in at A (FIG. 2) corresponding to the voltage-value selected. During the coating operation, the read bits of the threshold value, also consisting of a binary code, are fed in parallel to a binary comparison-switching-device (not shown) contained in the control-circuit ST. The comparison switching device receives at its other inputs the bits fed in parallel by an analog-digital converter A/D of a further binary code corresponding to the continuously measured operating current $I_{actual}$. When operating current $I_{actual}$ reaches the stored threshold value, the microprocessor, controlled by the comparison-switching-device, produces a shut-off signal Ab for high-voltage source HS.

The microprocessor $\mu$P may receive commands from an over-riding process-control which delivers to it, among other things, an in/out signal. The selected voltage at input A signals a "change" signal for controlling the takeout of the voltage-code at input A from a data-bus of the process-control and at an input W for the selection of possibly stored different voltage current curves. Based upon the voltage-code at input A, the microprocessor $\mu$P, in turn, can pass on a corresponding analog control-signal $U_{rated}$ through a digital/analog convertor D/A to high-voltage source HS. Moreover, the microprocessor $\mu$P may receive trouble reports from the high-voltage source HS or produce them for the process-control.

In FIG. 1, an additional curve $I_{ZS}$ is shown between operating-current curve $I_B$ and the shut-off curve $I_{AS}$. The intermediate threshold values of curves $I_{ZS}$, which are like the shut-off of current threshold values according to curve $I_{AS}$, are stored by the microprocessor $\mu$P based upon the initially measured normal values of operating current $I_B$ calculated and are continuously compared with actual operating current values $I_{actual}$. However, if the intermediate threshold values of curve $I_{ZS}$ (which may, for example, be 15% higher than normal operating current $I_B$) are exceeded, the high-voltage source H is not shut off. Instead, an acoustical and/or optical forewarning signal for the operating personnel is produced at output V from control-circuit ST.

In the event of a gradual increase in the operating current, the subject invention makes it possible for the crew to check the installation at a suitable moment, for instance, just after a body has been fully coated. In the event of advanced contamination or some other relatively slow change in operating conditions, the installation can be returned to its normal condition before the coating operation is continued. This is a simple way of eliminating unexpected shutdowns occurring at an awkward time and not due to danger of a voltage breakdown. The forewarning range, corresponding to the vertical distance between curves $I_{ZS}$ and $I_{AS}$ in FIG. 1, is large enough to allow the crew enough time to wait for a suitable moment to carry out the check.

When the operating current $I_B$, and therefore curves $I_{ZS}$ and $I_{AS}$ which are dependent thereon, changes as a result of a change in operating parameters, for instance a different enamel in which the effect upon the operating current is known, it is not absolutely necessary to determine the normal operating-current values once again before the coating operating begins by taking measurements. In such cases, it is possible for the computer itself to calculate the threshold values now applicable and to store different curves for the different operating parameters. The different curves are selected from the already mentioned signals at input W as required.

The apparatus described herein enables the operating personnel to carry out further formerly non-existent checks. An indicating unit AZ, which is controlled by computer and control-circuit ST, permits an optical display of measured operating current $I_{actual}$ of the stored threshold values pertaining to the high voltage selected and also of the actual voltage $U_{actual}$. The actual values are converted by an A/D convertor into binary informations. The indicating unit AZ may be a digital-display unit and/or a video terminal in the form of a monitor to which the information to be displayed is fed in the form of parallel bits at output Z from control-circuit ST. The control-circuit ST receives at input B command signals for the release of the desired information. This gives the operating personnel a picture of the operating conditions whenever the warning signal appears at output V.

Since the high voltage of each paint-spraying unit is to be monitored, it is desirable to install a printed-circuit-board for each unit. The circuit board should be equipped with the integrated switching circuits containing the microprocessor $\mu$P and control circuits ST. This is a low-cost item.

The system described herein for automatically adapting a shut-off current threshold to the voltage selected may easily be combined with other safety shut-off systems, especially the system disclosed in German OS No. 27 34 341 above mentioned. It may be necessary to shut off the high voltage of the coating installation before the shut-off current threshold is reached, for example if the current changes more rapidly, i.e. if, over a given period of time the current changes by a larger amount or by a larger percentage than is admissible for reasons of safety.

We claim:

1. A method for monitoring the operation of an electrostatic coating installation operated by a selectably variable high voltage for large workpieces, said method comprising the steps of predetermining the normal operating current of the high voltage source and a higher current threshold value, switching off the high voltage automatically when the current threshold is reached, characterized by measuring prior to coating the normal current values for the respective voltage values, determining the threshold values on the basis of the normal values, storing jointly the normal current values and the threshold values, measuring the operating current during the coating operation, comparing the operating current with the stored value automatically selected according to the voltage selected, determining an intermediate threshold based upon the stored values and as a function of the selected voltage values, automatically adjusting the intermediate threshold value between the normal value and the current threshold value, and producing a warning signal when the intermediate threshold value is exceeded.

2. A method for monitoring the operation of an electrostatic coating installation operated by a selectably variable high voltage for large workpieces, said method comprising the steps of predetermining the normal operating current of the high voltage source and a higher current threshold value, switching off the high voltage automatically when the current threshold is reached, characterized by measuring prior to coating the normal current values for the respective voltage values, determining the threshold values on the basis of the normal values, storing jointly the normal current values and the threshold values, measuring the operating current during the coating operation, comparing the operating current with the stored value automatically selected according to the voltage selected, storing the normal and threshold values of the current as binary data and calculating digitally the current threshold values from the normal values, determining an intermediate threshold based upon the stored values and as a function of the selected voltage values, automatically adjusting the intermediate threshold value between the normal value and the current threshold value, and producing a warning signal when the intermediate threshold value is exceeded.

3. A method as set forth in claims 1, or 2 further characterized by storing jointly the respective normal and threshold values for different kinds of enamel and other operating conditions and moving out of storage the stored values on the basis of the actual operating conditions.

* * * * *